US005531082A

United States Patent [19]

Wolk et al.

[11] Patent Number: 5,531,082

[45] Date of Patent: Jul. 2, 1996

[54] PORTABLE SECURITY CASE

[75] Inventors: Douglas J. Wolk, Hamlin; William C. Carapezza; Richard J. Sylvester, both of Rochester, all of N.Y.

[73] Assignee: John D. Brush & Co., Inc., Rochester, N.Y.

[21] Appl. No.: 324,874

[22] Filed: Oct. 18, 1994

[51] Int. Cl.[6] ..... B65B 55/14; F05B 65/48

[52] U.S. Cl. ..... 70/63; 70/18; 70/312

[58] Field of Search ..... 70/119, 126, 63, 70/18, 30, 312, 311, 461, DIG. 63; 109/52, 51, 50

[56] References Cited

U.S. PATENT DOCUMENTS

| | | | |
|---|---|---|---|
| 1,352,906 | 9/1920 | Mamiya | 109/51 |
| 1,567,901 | 12/1925 | Blair | 70/312 |
| 2,911,814 | 10/1959 | Williams | 109/45 |
| 3,204,436 | 9/1965 | Nemsky | 70/312 |
| 4,195,579 | 4/1980 | Doyal | 109/52 |
| 4,474,116 | 10/1984 | Castenada et al. | 109/51 |
| 4,573,332 | 3/1986 | Ma . | |
| 4,667,491 | 5/1987 | Lokken et al. . | |
| 4,838,052 | 6/1989 | Williams et al. | 70/63 |
| 4,987,836 | 1/1991 | Owen | 109/52 |

FOREIGN PATENT DOCUMENTS

| | | | |
|---|---|---|---|
| 1271045 | 7/1990 | Canada | 70/63 |
| 2181781 | 4/1987 | United Kingdom | 70/63 |

*Primary Examiner*—Darnell M. Boucher
*Attorney, Agent, or Firm*—Eugene Stephens & Associates

[57] ABSTRACT

A portable security case (10) includes a base (12) and a lid (14). A cable lock (32) locks both the lid (14) to the base (12) and the base (12) to another object (59). A spring catch (66) and dead bolts (82) also lock the lid (14) to the base (12). A spring latch (68) prevents the spring catch (66) from unlocking when the cable lock (32) is locked. A cable (40) is captured in different positions within the base (12) for adjusting its length, and hinges (91 and 93) are mounted in interior side walls (28 and 30) of the base (12) to provide an uninterrupted parting line between the base (12) and the lid (14).

7 Claims, 7 Drawing Sheets

PORTABLE SECURITY CASE

TECHNICAL FIELD

The invention relates to portable cases that can be locked for protecting contents from loss or theft and, in particular, to such cases that can also be locked to other objects.

BACKGROUND

One example of a known portable security case is disclosed in U.S. Pat. No. 4,573,332 to Ma. The case includes two hinged sections and a cable lock that both locks the two sections together and locks the case to an immovable object. The cable lock is mounted within a bottom section of the case and includes a combination dial that protrudes through a top section of the case. One end of a cable is fixed to the lock, and the other end of the cable fits through a hole in the top section of the case before entering the lock.

Although the cable lock itself is very strong, only one of two front corners of the case is secured by the lock. The other front corner is susceptible to prying. Hinges, which are susceptible to breakage, are exposed on a back wall of the case. The cable has a fixed length that cannot be adjusted to fit more tightly around an immovable object. On the other hand, the only provision for holding the case closed before securing it to the immovable object is also the cable lock, which requires a combination to be entered before the case can be reopened.

A portable lock box is disclosed in U.S. Pat. No. 4,667,491 to Lokken et al. A tray slides within a first tubular member, and the first tubular member together with the tray slides within a second tubular member. A key lock mounted in the first tubular member includes a latch that engages a slot in the second tubular member. A cable is attached to the lock box by two knobs that are captured within the first tubular member behind slots that are closed by the second tubular member.

The three-part structure of the lock box is cumbersome to assemble and disassemble. The single key lock is the only provision for holding the case closed, and the cable is not adjustable in length.

SUMMARY OF INVENTION

Our invention primarily involves a portable security case that is economical and easy to use and provides security for valuables in a variety of settings. For example, we envision our case to be especially suitable for use by travelers, who need temporary safekeeping for their valuables in such settings as automobiles, motel rooms, and pool, picnic, or other leisure areas. Our case can also be used to secure valuables in businesses, homes, and schools.

One embodiment of our invention has a base and a lid that can be opened and closed with respect to the base. A primary lock locks both the lid to the base and the base to another object. A secondary lock also locks the lid to the base. The primary and secondary locks are interconnected to that the secondary lock cannot be unlocked unless the primary lock is also unlocked.

The primary lock is preferably a cable lock, and the secondary lock is preferably a catch. A latch interconnects the cable lock and catch. The case is held closed by the catch, which can be released by a push button. However, when the cable lock is locked, the latch is moved into engagement with the catch for preventing the catch from unlocking. Thus, the catch provides for holding the case closed when the cable lock is unlocked, but both the catch and the cable lock hold the case closed when the cable lock is locked.

The base and lid can also be locked together by a tertiary lock that cannot be unlocked unless the secondary lock is also unlocked. For example, the tertiary lock could be a dead bolt that is swung into engagement by action of a hinge between the base and the lid. The dead bolt provides a third location for holding the case closed when the cable lock is locked.

Another embodiment of our invention features a cable that can be adjusted in length within a similar case. A cable lock is mounted on the base and includes a bore for receiving a first end of the cable. The lid also includes a bore through which the first end of the cable is passed for locking the lid to the base. A channel is formed in the base with abutments spaced along its length for capturing a second end of the cable in different positions along the channel. The lid has mating surfaces for locking the second end of the cable in one of the different positions when the lid is closed.

A knob can be mounted on the second end of the cable to assist capture by one of the abutments. A through hole can be formed through the knob for passing the first end of the cable. Thus, instead of capturing the knob within the case, the cable can be threaded through the knob to form a noose for further extending the effective length of the cable.

Yet another embodiment of our invention features a pair of hidden hinges and an uninterrupted parting line. The base is made with front, back, and two side exterior walls, as well as two side interior walls. The lid is made with front, back, and two side exterior walls. The parting line is formed between the exterior walls of the base and lid. The pair of hinges each include a leaf attached to the lid and a pintle mounted in one of the interior walls. The leaves are pivotable within respective spaces formed between the interior and exterior side walls for protecting contents of the safe from the leaf movements. The parting line is shaped to provide clearance between the base and the lid when the lid is opened and to prevent gaps between the base and the lid when the lid is closed.

Cams urge the pintles into engagement with sockets formed in the interior side walls to further strengthen the hinges. A lip in the main body along the parting line forms a continuous seal between the lid and the base to resist prying and to protect contents from contamination by external agents such as water or dirt.

The hidden hinges and uninterrupted parting line may be used as improvements in a variety of different types of cases and other hinged structures. However, the features of all three embodiments are preferably used together to make a significantly improved portable security case.

DRAWINGS

DETAILED DESCRIPTION

Figure 1:
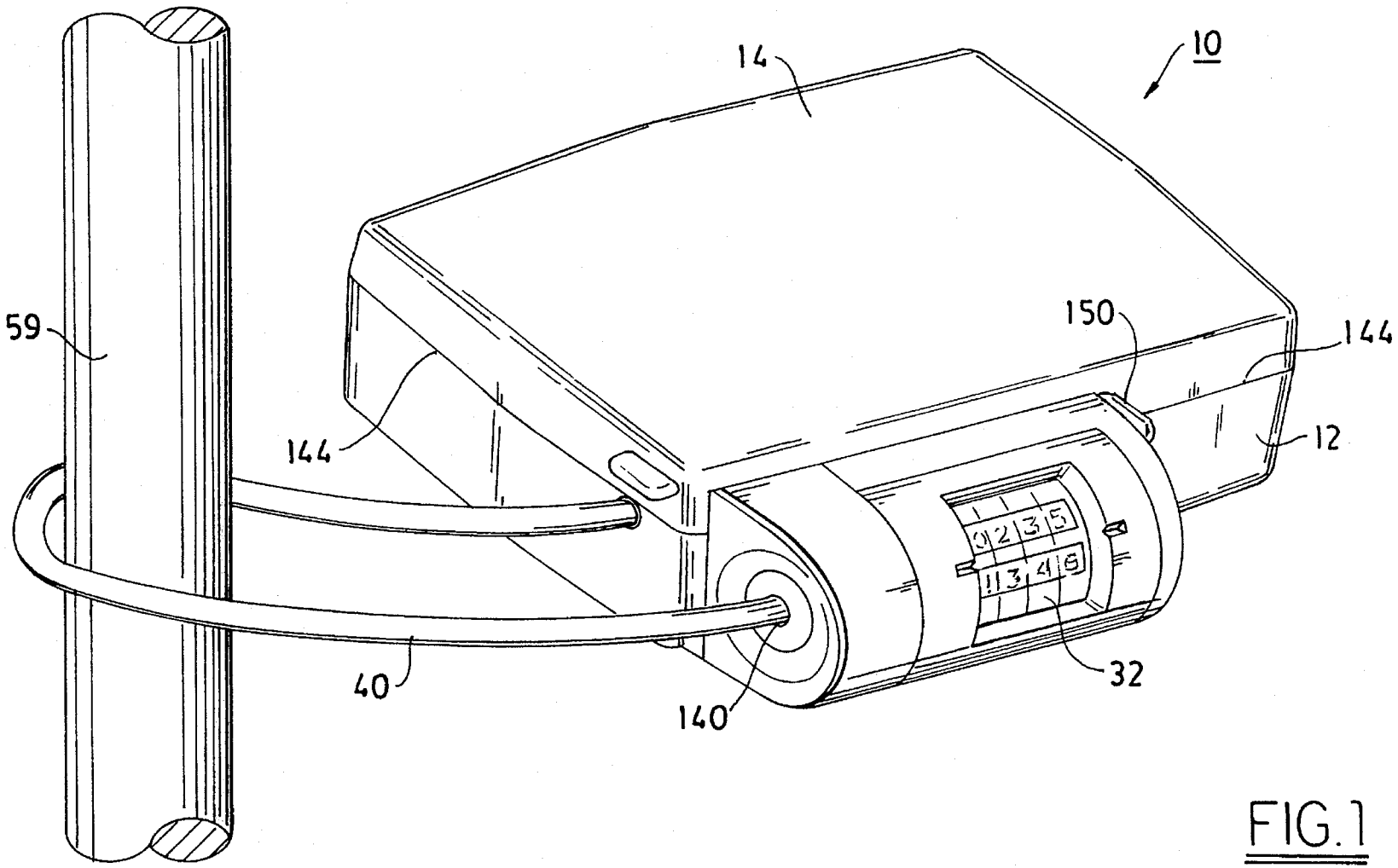
FIG. 1 is a perspective view of a portable security case according to our invention.
Figure 2:
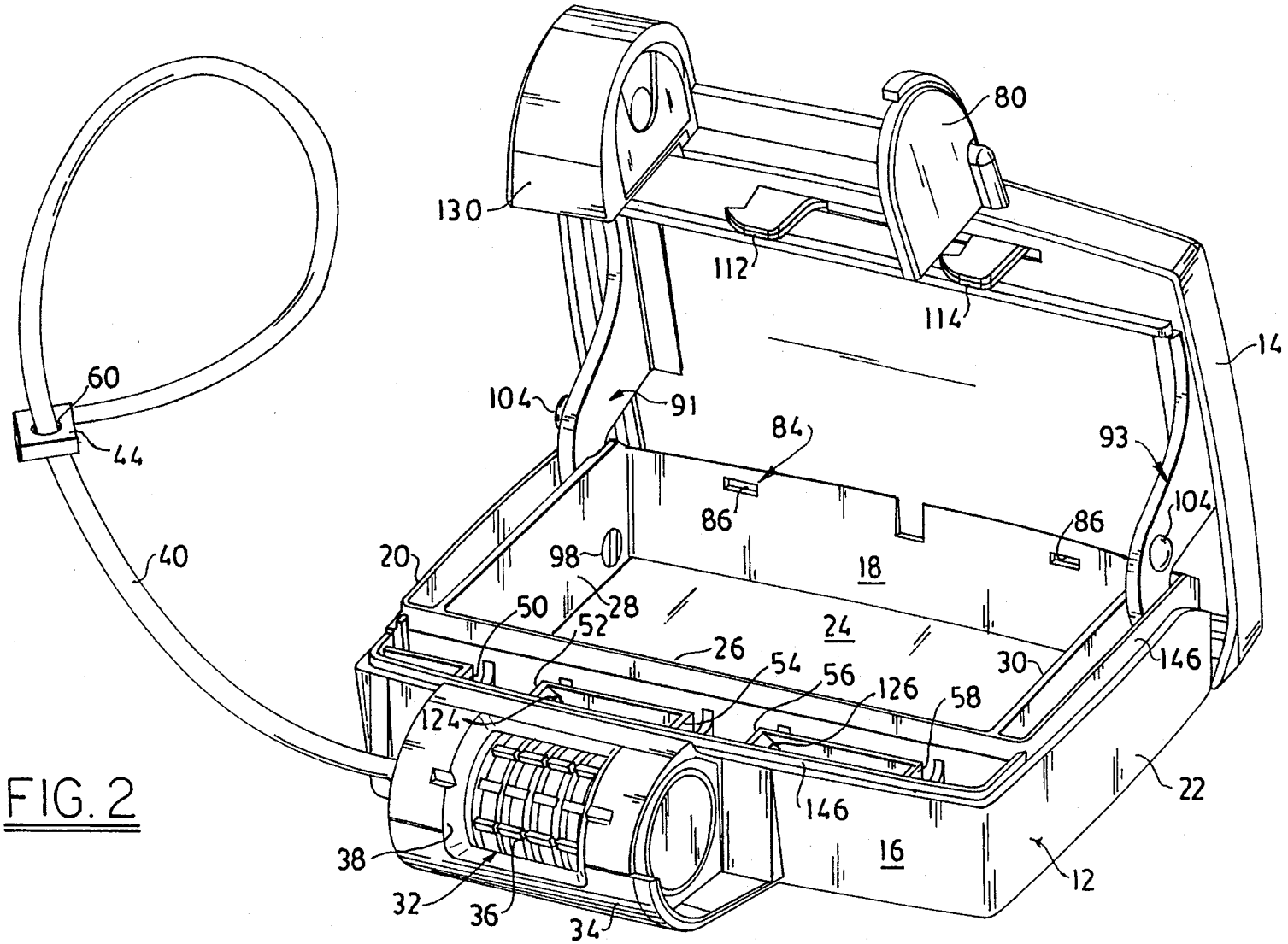
FIG. 2 is a perspective view of the case opened to show internal structures of a base and a lid.

A portable security case 10 embodying several different inventive features is illustrated by the drawing figures. The case 10, as shown in FIGS. 1 and 2, includes a base 12 and a lid 14. Both the base 12 and the lid 14 are preferably made of a durable material that can be molded. A polycarbon material is preferred for strength, but ABS and ASR resins would be more economical.

Figure 3:
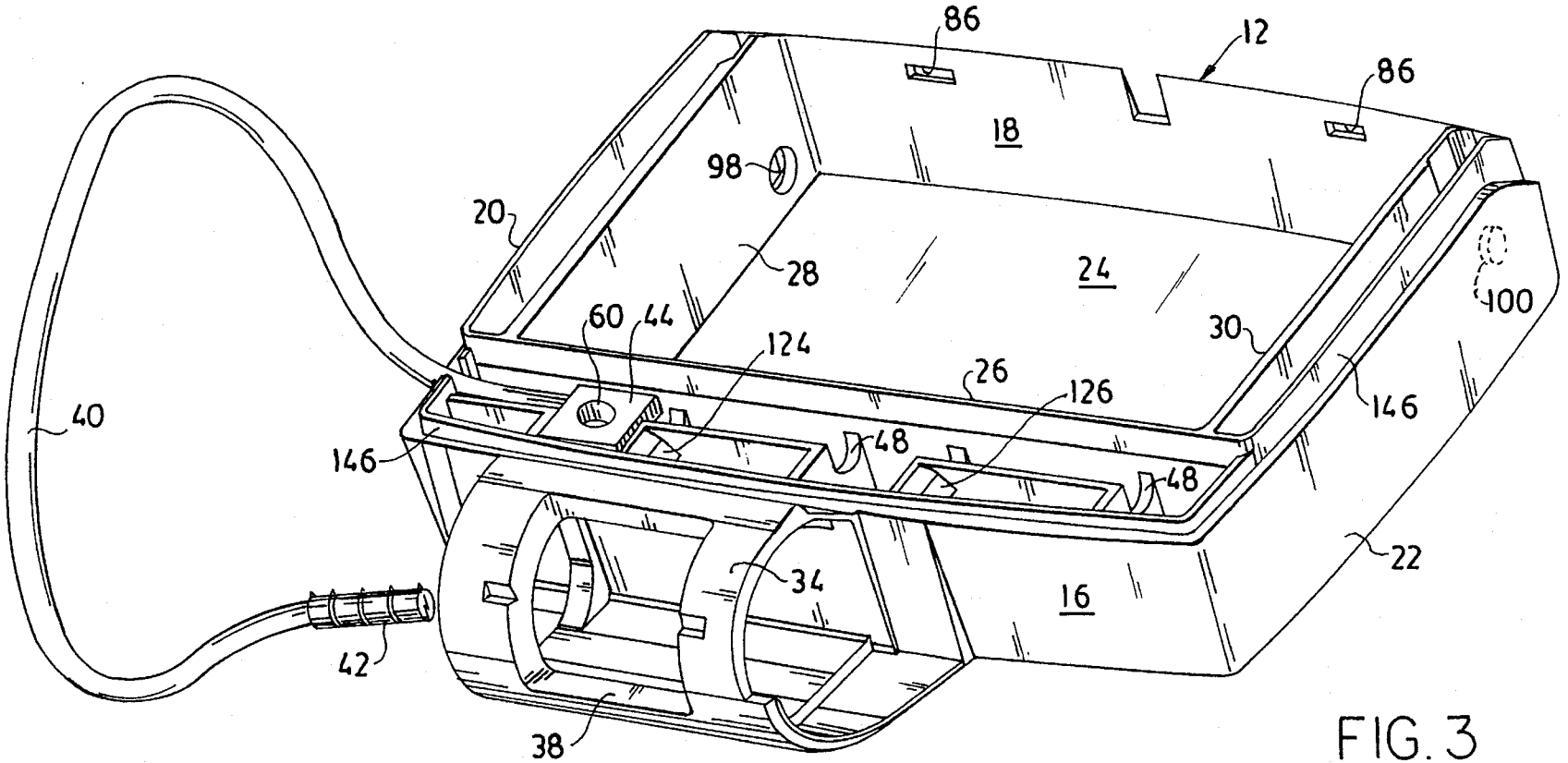
FIG. 3 is a perspective view of the base.

The base 12, which is shown separately in FIG. 3, includes front and back exterior walls 16 and 18, side exterior walls 20 and 22, and a bottom 24. Within the base 12 are front interior wall 26 and two side interior walls 28 and 30.

Figure 4:
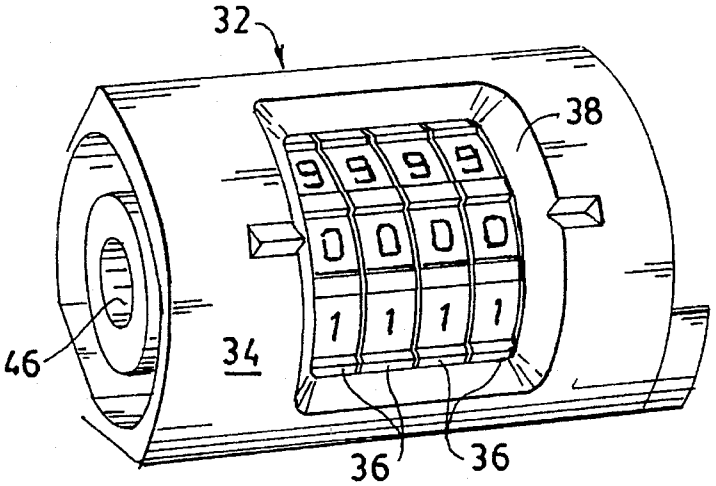
FIG. 4 is a cut-away perspective view of a cable lock within a housing that projects from the base.

A barrel-shaped cable lock 32, which is shown separately in FIG. 4, is mounted on the front exterior wall 16 of the base 12 within a cylindrical frame 34. Barbs (not shown) surrounding cable lock 32 and a stake (also not shown) secure the cable lock 32 within the cylindrical frame 34. Four coaxial number wheels 36 are visible within a window 38 in the cylindrical frame 34 for dialing numerical combinations for unlocking the cable lock 32.

A cable 40, which is shown in the first three drawing figures, includes knobs 42 and 44 at opposite ends. The knob 42 fits within a bore 46 of the cable lock 32 for locking one end of the cable 40 to the base 12. The knob 44 can be captured within the base 12 along a channel 48 formed in abutments 50, 52, 54, 56, and 58 that connect the front exterior wall 16 with the front interior wall 26. The knob 44 has a square shape that is sized to fit between pairs of the abutments 50, 52, 54, 56, and 58 in any one of three positions along the channel 48. Closing the lid 14 locks the knob 44 in place at one of the three positions.

In the view of FIG. 3, the knob 44 is captured in a first of the three positions between the abutments 50 and 52. The second position is between the abutments 54 and 56, and the third position is between the abutment 58 and the side exterior wall 22. The three positions allow a length of the cable 40 extending from the base 12 to be adjusted for cinching the case 10 to different size objects 59. A hole 60 in the knob 44 is sized to permit the knob 42 to pass through the knob 44, thereby forming a noose (see FIG. 2) for further extending the useful length of the cable 40.

Figure 7:
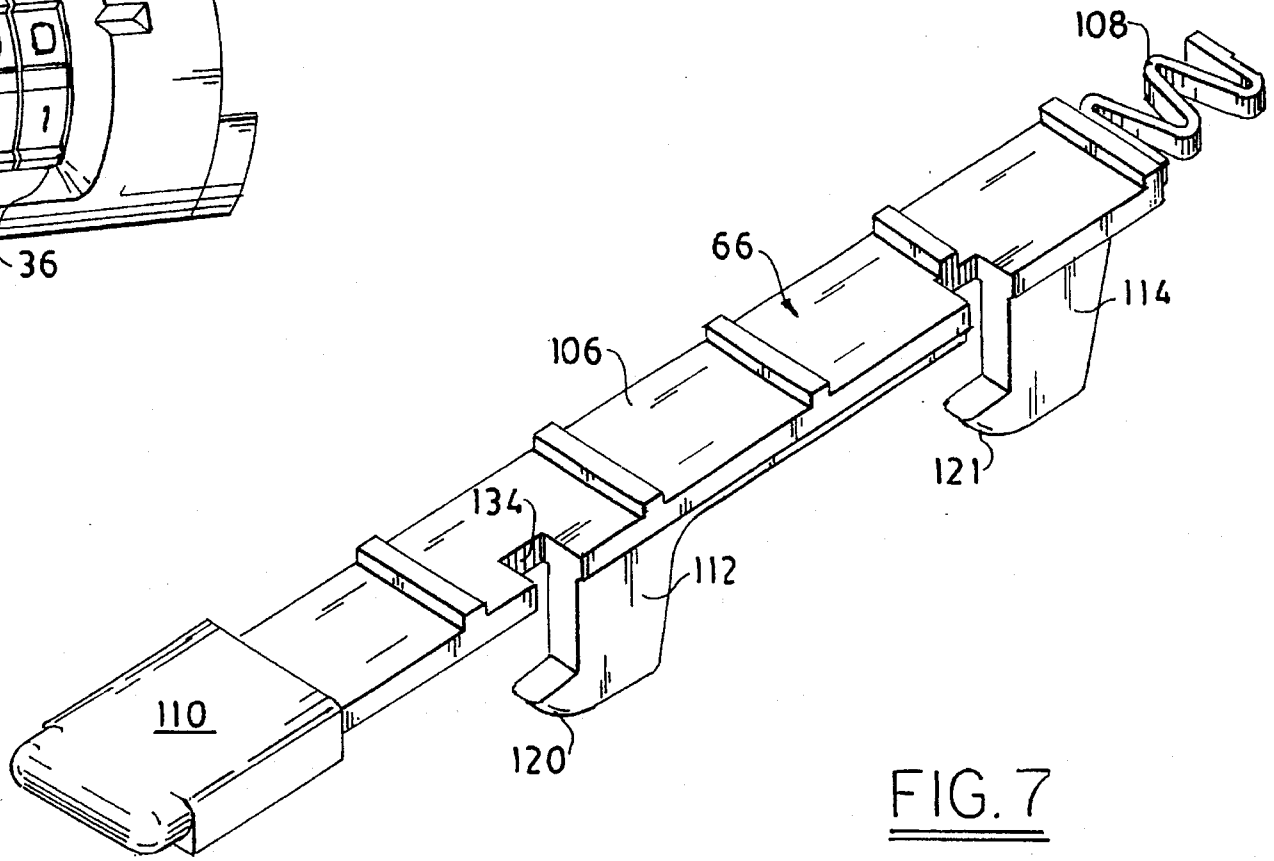
FIG. 7 is a perspective view of a spring catch portion of the lid.
Figure 5:
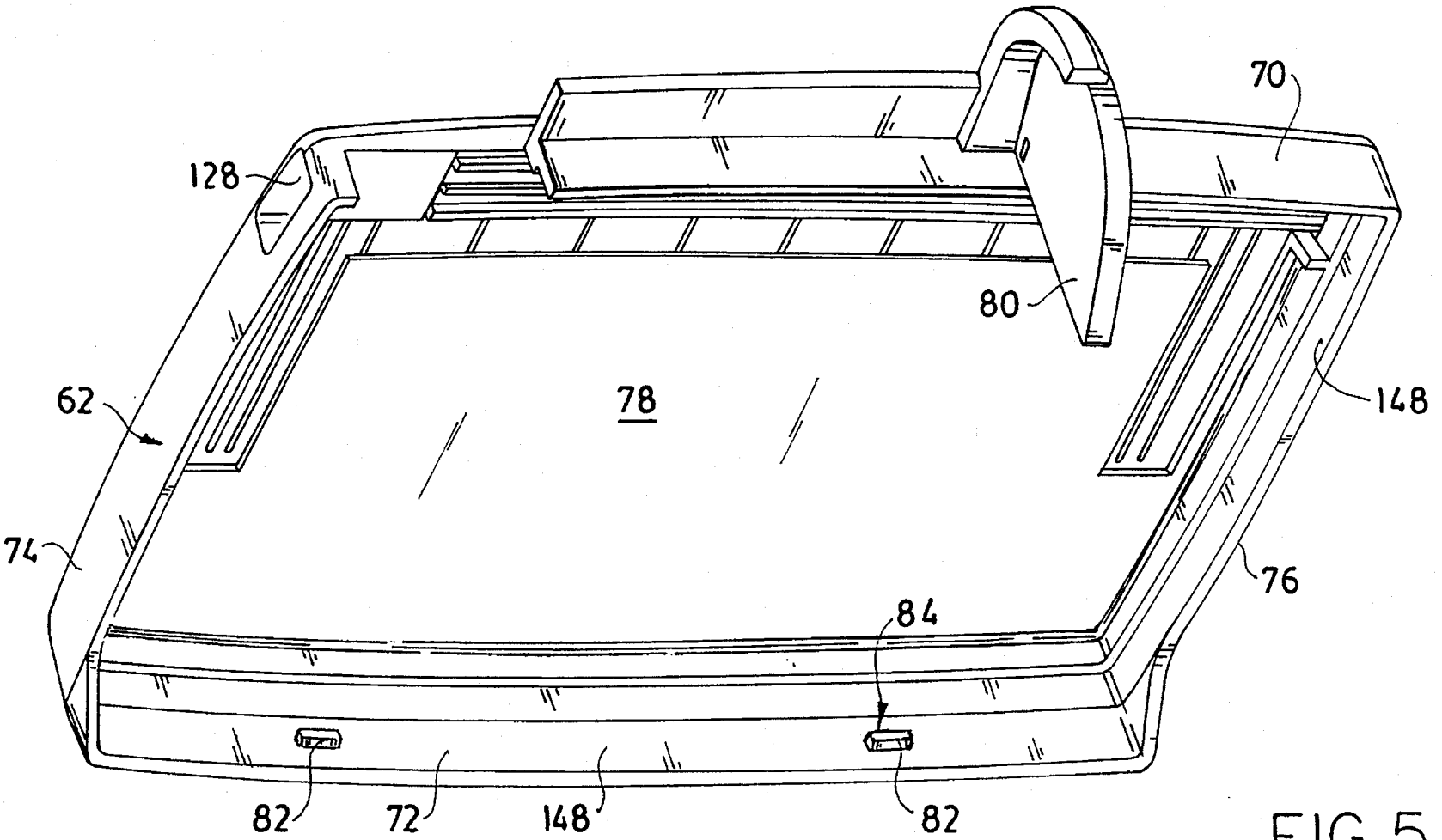
FIG. 5 is a perspective view of a shell portion of the lid.
Figure 6:
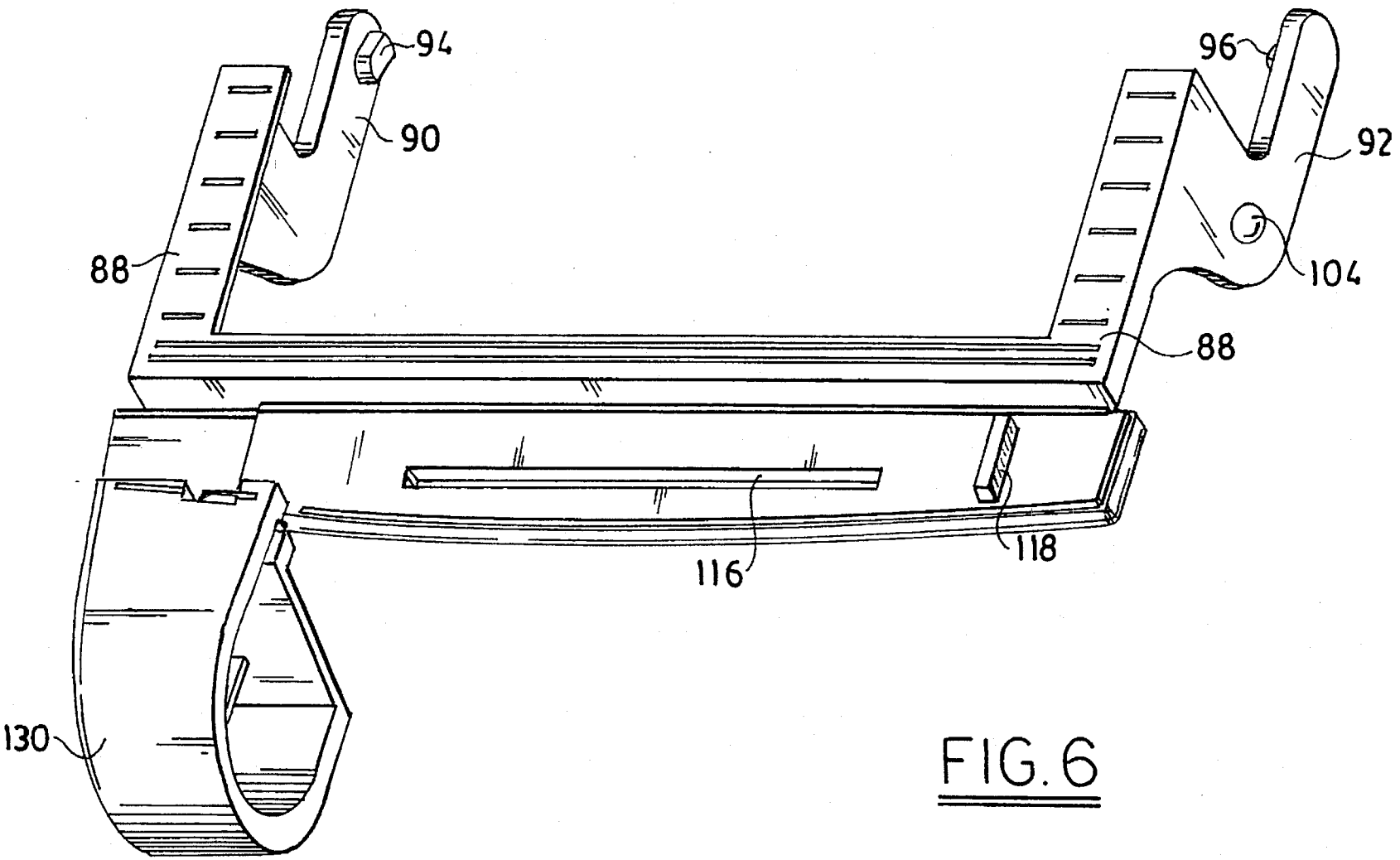
FIG. 6 is a perspective view of a frame portion of the lid.
Figure 9:
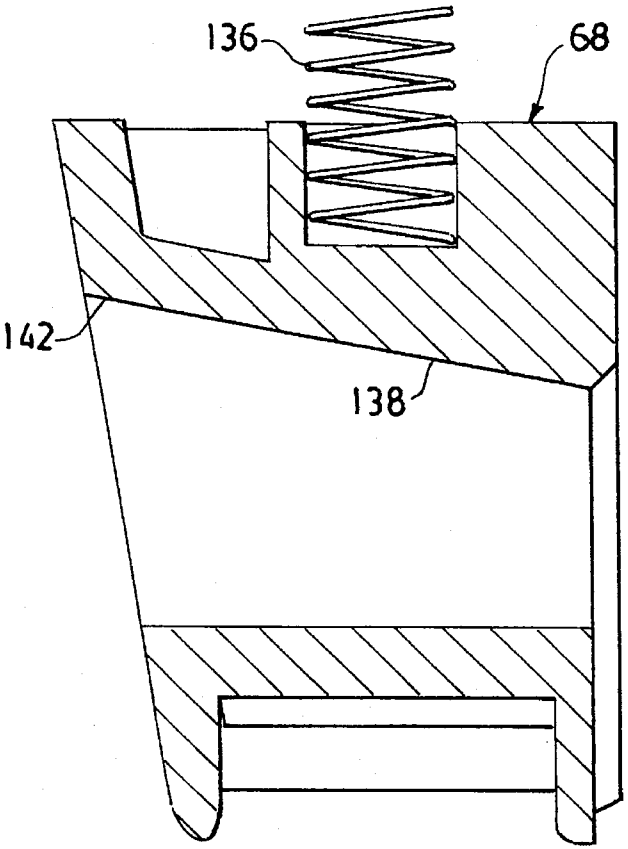
FIG. 9 is a cross-sectional view through the spring latch portion of the lid.
Figure 8:
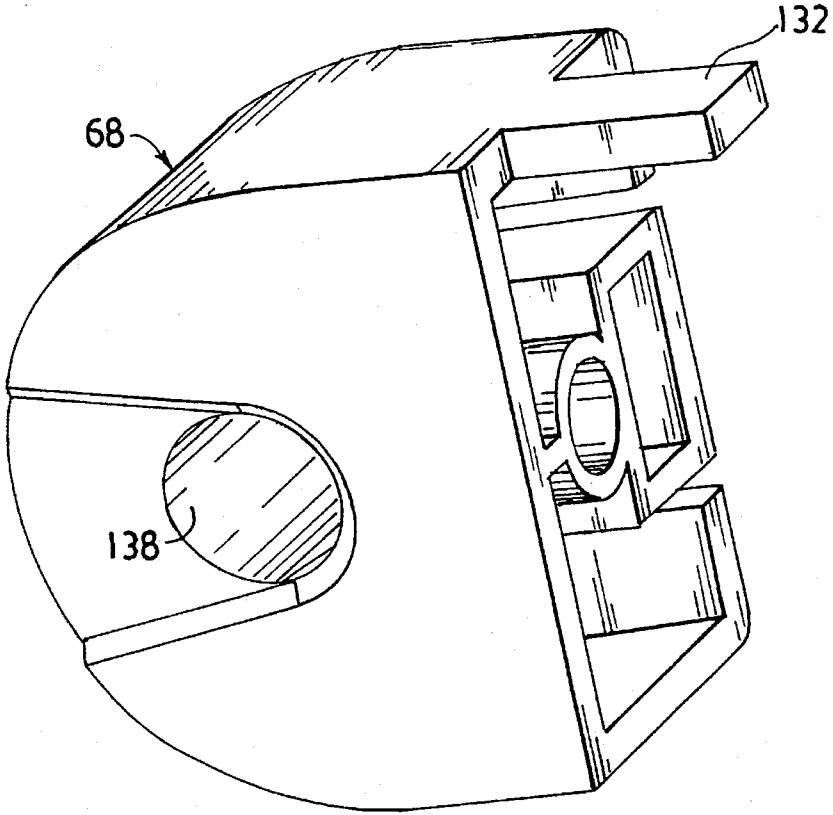
FIG. 8 is a perspective view of a spring latch portion of the lid.

The lid 14 is assembled from several parts which include a shell 62 shown in FIG. 5, a frame 64 shown in FIG. 6, a spring catch 66 shown in FIG. 7, and a spring latch 68 shown in FIGS. 8 and 9. The shell 62 of the lid includes front and back walls 70 and 72, two side walls 74 and 76, and a top 78. A first end cap 80 projects from the front wall 70 for enclosing one end of the cylindrical frame 34 that houses the cable lock 32. Dead bolts 82 of dead bolt locks 84 project inside the back wall 72 in alignment with openings 86 in the back wall 18 of the base for locking the two back walls 72 and 18 together when the lid 14 is closed. Opposite directions of arcuate movement of the lid 14 with respect to the base 12 lock and unlock the dead bolt locks 84.

The frame 64 is attached to the top 78 of the shell 62 along a mounting surface 88. A permanent glue is preferably used for this purpose. Elbow-shaped hinge leaves 90 and 92 of hinges 91 and 93 extend from the mounting surface 88. Pintles 94 and 96 formed at ends of the leaves 90 and 92 are pivotable within sockets 98 and 100 that are formed in respective side interior walls 28 and 30 of the base. The hinge leaves 90 and 92 are pivotable within narrow spaces between the side interior walls 28 and 30 and the side exterior walls 20 and 22. The interior walls 28 and 30 protect contents of the case 10 from exposure to movement of the leaves 90 and 92.

Cams 102 and 104, which can be formed as bosses located on outer surfaces of the hinge leaves 90 and 92, engage inner surfaces of the side exterior walls 18 and 20 when the lid 14 is closed. The cams 102 and 104 urge the hinge leaves 90 and 92 against the side interior walls 28 and 30 for locking the pintles 94 and 96 within the sockets 98 and 100 of the side interior walls.

The spring catch 66 has an elongated body 106 with a first compression spring 108 mounted at one end and a button 110 mounted at the other end. A pair of hooks 112 and 114 extend from a bottom of the catch body 106 through a slot 116 in the frame 64. The first compression spring 108 contacts a stop 118 of the frame 64 for urging the hooks 112 and 114 into engagement with interlocking portions of the abutments 52 and 56. Camming surfaces 120 and 122 of the hooks 112 and 114 contact mating surfaces 124 and 126 of the abutments 52 and 56 for automatically locking the spring catch 66 when the lid 14 is closed. The first compression spring 108 also urges the button 110 through an opening 128 in the shell 62. However, the button 110 can be depressed against the spring force for unlocking the spring catch 66.

The spring latch 68 is housed within a second end cap 130 that projects from the frame 64. A key 132 extends from the spring latch 68 in alignment with a keyway 134 in the catch body 106 when the spring catch 66 is locked. However, a second compression spring 136, which extends between the spring latch 68 and the second end cap 130, biases the key 132 of the spring latch 68 out of engagement with the keyway 134 of the spring catch 66.

A tapered bore 138 in the biased spring latch 68 is slightly offset with respect to both a bore 140 (see FIG. 1) in the second end cap 130 and the bore 46 of the cable lock 32. However, one end 142 of the tapered bore 138 is enlarged for receiving the knob 42 of the cable 40 through the bore 140. Movement of the knob 42 through the tapered bore 138 pushes spring latch 68 against the second compression spring 136 and thereby moves the key 132 of the spring latch into engagement with the keyway 134 of the spring catch 66. Accordingly, when the knob 42 of the cable 40 is moved through the spring latch 68 into engagement with the bore 46 of the cable lock 32, both the cable lock 32 is locked and the spring catch 66 is prevented from being unlocked.

Thus, several mechanisms interact to secure the lid 14 tightly to the base 12. First, the cams 102 and 104 urge the pintles 94 and 96 of the hinge leaves 90 and 92 into engagement with the sockets 98 and 100 in the side interior walls 28 and 30 of the base 12. Second, the dead bolts 82 in the back wall 72 of the lid 14 engage mating openings 86 in the back exterior wall 18 of the base 12. Third, the spring catch 66 locks the lid 14 to the abutments 52 and 56 between the front exterior and interior walls 16 and 26 of the base 12. Fourth, the spring latch 68 prevents the spring catch 66 from opening; and fifth, the cable 40 locks the second end cap 130 of the lid 14 to the cable lock 32 mounted in the cylindrical frame 34 of the base 12.

The case 10 is also protected by a parting line 144 (see FIG. 1) that is uninterrupted by hinges and by mating stepped lips 146 and 148 (see FIG. 2) that provide overlap between the base 12 and lid 14. Both of these features resist attempts to pry apart the base 12 and lid 14. The stepped lip 146 follows the front wall 16, back wall 18, and two side walls 20 and 22 of the base. The stepped lip 148 follows the front wall 70, back wall 72, and two side walls 74 and 76 of the lid 14.

The parting line 144 curves downwardly approaching the back walls 18 and 72 to provide clearance between the base 12 and the lid 14 while the lid is opened and to prevent gaps between the base and the lid while the lid is closed. The two stepped lips 146 and 148 also increase in height toward the back walls 18 and 72 to further protect the case 10 from prying. The stepped lips 146 and 148 can also be angled to redirect the prying force away from a direction that would raise the lid 14.

The case 10 is unlocked by dialing the number wheels 36 to a preset combination and retracting the knob 42 of the cable 40 from the bore 46 of the cable lock 32 through both the tapered bore 138 of the spring latch 68 and the bore 140 of the second end cap 130. The spring catch 66 is released by squeezing together the button 110 with a "faux" button 150 that is mounted on the first end cap 80. Pivotal movement of the lid 14 disengages both the dead bolt locks 84 and the cams 102 and 104 of the hinges 91 and 93.

We claim:

1. A portable security case comprising:

a base;

a lid that can be opened and closed with respect to said base;

a primary lock that locks both said lid to said base and said base to another object;

a secondary lock that locks said lid to said base;

said primary and secondary locks being interconnected so that said secondary lock cannot be unlocked unless said primary lock is also unlocked;

said primary and secondary locks being interconnected by a latch that is movable between positions of engagement and disengagement with said secondary lock;

said primary lock being a cable lock that includes a bore for capturing one end of a cable; and said latch being moved into engagement with said secondary lock by inserting said one end of the cable into said bore.

2. The case of claim 1 in which said secondary lock is a catch that is movable between locked and unlocked positions.

3. The case of claim 2 in which said latch is engageable with said catch for preventing said catch from moving from said locked to said unlocked position.

4. The case of claim 3 in which said latch includes a bore that is offset with respect to said bore of the cable lock for moving said latch into a position of engagement with said secondary lock.

5. A portable security case comprising:

a base;

a lid that can be opened and closed with respect to said base;

a cable lock mounted on said base including a cable having first and second ends:

said cable lock also including a first bore that receives said first end of the cable for locking said first end of the cable to said base;

said lid including a second bore that receives said first end of the cable in alignment with said first bore for locking said lid to said base;

a channel formed in said base through a plurality of abutments that are spaced for capturing said second end of the cable in different positions along said channel;

said lid having mating surfaces for locking said second end of the cable in one of said different positions along said channel when said lid is closed;

a spring catch for locking said lid to said base;

a spring latch for preventing said spring catch from unlocking while said cable lock is locked; and said spring catch including a button that protrudes from said lid and is depressible toward said lid for unlocking said spring catch from said base while said cable lock is unlocked.

6. The case of claim 5 in which said spring latch includes a third bore that is offset with respect to said first and second bores for moving said spring latch into a position of engagement with said spring catch.

7. The case of claim 6 in which said third bore is tapered with an enlarged opening adjacent to said second bore.

* * * * *